US010302005B2

(12) United States Patent
Umeno et al.

(10) Patent No.: US 10,302,005 B2
(45) Date of Patent: May 28, 2019

(54) CONTROL DEVICE AND PROGRAM

(71) Applicant: YAMADA MANUFACTURING CO., LTD., Kiryu-shi, Gunma (JP)

(72) Inventors: Masanori Umeno, Kiryu (JP); Tetsuya Kajiura, Kiryu (JP); Yutaka Osawa, Kiryu (JP)

(73) Assignee: YAMADA MANUFACTURING CO., LTD., Kiryu-Shi (JP)

( * ) Notice: Subject to any disclaimer, the term of this patent is extended or adjusted under 35 U.S.C. 154(b) by 0 days.

(21) Appl. No.: 15/697,580

(22) Filed: Sep. 7, 2017

(65) Prior Publication Data

US 2018/0080368 A1 Mar. 22, 2018

(30) Foreign Application Priority Data

Sep. 16, 2016 (JP) ..... 2016-181321

(51) Int. Cl.

| | |
|---|---|
| ***F01P 7/16*** | (2006.01) |
| ***F02M 26/28*** | (2016.01) |
| ***F02M 26/73*** | (2016.01) |
| ***F01P 3/22*** | (2006.01) |
| *F01P 7/14* | (2006.01) |

(52) U.S. Cl.

CPC ..... *F01P 7/167* (2013.01); *F01P 3/22* (2013.01); *F02M 26/28* (2016.02); *F02M 26/73* (2016.02); *F01P 2007/146* (2013.01); *F01P 2025/32* (2013.01); *F01P 2037/02* (2013.01)

(58) Field of Classification Search

CPC ... F01P 2007/146; F01P 7/167; F01P 2023/08
See application file for complete search history.

(56) References Cited

U.S. PATENT DOCUMENTS

2009/0312898 A1* 12/2009 Hashimoto ..... G05B 19/0428 701/29.1
2010/0180630 A1* 7/2010 Ogawa ..... F25B 41/04 62/498

(Continued)

FOREIGN PATENT DOCUMENTS

JP 2002-021563 1/2002

*Primary Examiner* — Long T Tran
(74) *Attorney, Agent, or Firm* — Rankin, Hill & Clark LLP

(57) ABSTRACT

A control device is a device for controlling a control angle of a valve which has a minimum value in a change in opening area in accordance with the control angle, and includes a control angle instruction acquisition unit configured to acquire a control angle instruction of the valve, an expansion instruction acquisition unit configured to acquire an expansion instruction indicating whether to expand the opening area, a control angle information acquisition unit configured to acquire control angle information indicating a control angle of the valve, a control angle calculation unit configured to calculate a control angle of the valve on the basis of the control angle instruction acquired by the control angle instruction acquisition unit, the expansion instruction acquired by the expansion instruction acquisition unit, and the control angle information acquired by the control angle information acquisition unit, and a drive control unit configured to output drive information of the valve based on a control angle calculated by the control angle calculation unit.

8 Claims, 10 Drawing Sheets

(56) References Cited

U.S. PATENT DOCUMENTS

2012/0260678 A1* 10/2012 Yoshida ..... F25B 41/062
62/56
2015/0362236 A1* 12/2015 Jiang ..... F25B 41/062
137/12
2015/0370261 A1* 12/2015 Yokoyama ..... F02D 41/1401
700/282
2016/0332505 A1* 11/2016 Yamanaka ..... B60L 11/18

* cited by examiner

CONTROL DEVICE AND PROGRAM

BACKGROUND OF THE INVENTION

Field of the Invention

Embodiments of the present invention relate to a control device and a program.

Priority is claimed on Japanese Patent Application No. 2016-181321, filed in Japan on Sep. 16, 2016, the entire content of which is incorporated herein by reference.

Description of Related Art

Conventionally, a cooling water flow rate control device which controls a flow control valve placed at a junction of a radiator passage and a bypass passage (for example, Japanese Unexamined Patent Application, First Publication No. 2002-21563) has been disclosed.

A conventional technology described in Japanese Unexamined Patent Application, First Publication No. 2002-21563 described above has a relatively large movable range of a flow control valve when a flow rate of cooling water is changed from a small flow rate to a maximum flow rate. For this reason, according to the prior art, for example, when the flow rate of cooling water is maximized at the time of occurrence of a cooling failure such as overheating of an apparatus to be cooled, it may take a relatively long time to change a small flow rate to a maximum flow rate.

That is, according to the prior art, there might be a case that the flow rate cannot be rapidly maximized at the time of occurrence of a cooling failure, and there is a possibility that cooling performance at the time of occurrence of a cooling failure cannot be improved.

SUMMARY OF THE INVENTION

An object of the present invention is to provide a control device and a program which can improve cooling performance when a cooling failure occurs.

According to a first aspect of the present invention, a control device which controls a control angle of a valve which has a minimum value in a change in opening area in accordance with the control angle includes a control angle instruction acquisition unit configured to acquire a control angle instruction of the valve, an expansion instruction acquisition unit configured to acquire an expansion instruction indicating whether to expand the opening area, a control angle information acquisition unit configured to acquire control angle information indicating a control angle of the valve, a control angle calculation unit configured to calculate a control angle of the valve on the basis of the control angle instruction acquired by the control angle instruction acquisition unit, the expansion instruction acquired by the expansion instruction acquisition unit, and the control angle information acquired by the control angle information acquisition unit, and a drive control unit configured to output drive information of the valve on the basis of a control angle calculated by the control angle calculation unit.

According to a second aspect of the present invention, in the control device described above, the drive information may include information indicating a change direction of a control angle of the valve. The control angle calculation unit may determine a change direction of the control angle on the basis of the control angle information when the expansion instruction indicates expansion of the opening area. The drive control unit may output the drive information including the change direction determined by the control angle calculation unit.

According to a third aspect of the present invention, in the control device described above, the control angle calculation unit may determine the change direction on the basis of comparison between a control angle indicated by the control angle information and a control angle corresponding to the minimum value.

According to a fourth aspect of the present invention, in the control device described above, the drive information may include information indicating a drive force of the valve. When a target control angle indicated by the control angle instruction is different from a control angle indicated by the control angle information, the drive control unit may output the drive information indicating a larger drive force than a drive force of the valve when the target control angle is not different from the control angle indicated by the control angle information.

According to a fifth aspect of the present invention, in the control device described above, the control angle calculation unit may determine the change direction by setting the change direction to a direction in which the control angle of the valve decreases when the control angle indicated by the control angle information is less than a median value of a variable range of the control angle of the valve, and setting the change direction to a direction in which the control angle of the valve increases when the control angle indicated by the control angle information is equal to or larger than the median value of the variable range of the control angle of the valve.

According to a sixth aspect of the present invention, in the control device described above, the control angle calculation unit may calculate a control angle of the valve by setting an initial value of the control angle of the valve to a control angle other than the control angle corresponding to the minimum value among control angles of the valve.

According to a seventh aspect of the present invention, in the control device described above, the control angle calculation unit may calculate a control angle of the valve by setting the control angle of the valve to a control angle corresponding to a maximum value of the change in the opening area when the expansion instruction indicates expansion of the opening area.

According to an eighth aspect of the present invention, a program which causes a computer included in a control device for controlling a control angle of a valve that has a minimum value of a change in opening area in accordance with the control angle to execute functions; the functions include a control angle instruction acquisition step of acquiring a control angle instruction for the valve, an expansion instruction acquisition step of acquiring an expansion instruction instructing whether to expand the opening area, a control angle information acquisition step of acquiring control angle information indicating a control angle of the valve, a control angle calculation step of calculating a control angle of the valve on the basis of the control angle instruction acquired in the control angle instruction acquisition step, the expansion instruction acquired in the expansion instruction acquisition step, and the control angle information acquired in the control angle information acquisition step, and a drive control step of outputting drive information of the valve based on a control angle calculated in the control angle calculation step.

According to the control device and the program described above, it is possible to improve cooling performance when a cooling failure occurs.

DETAILED DESCRIPTION OF THE INVENTION

[Configuration of an in-Vehicle Cooling System 1]

Hereinafter, embodiments of the present invention will be described with reference to drawings.

Figure 1:
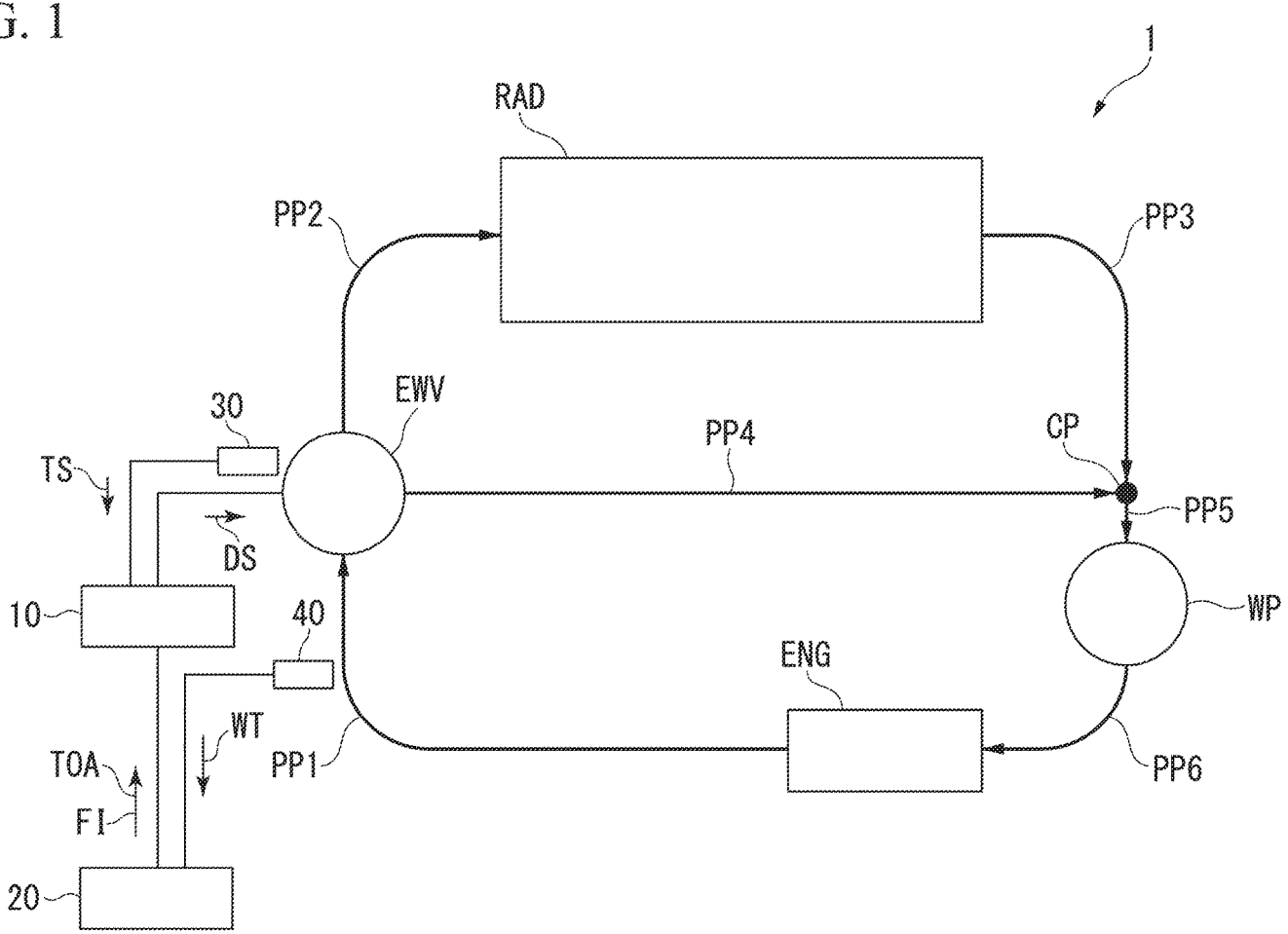
FIG. 1 is a diagram which shows an example of a configuration of an in-vehicle cooling system according to an embodiment of the present invention.

FIG. 1 is a diagram which shows an example of a configuration of an in-vehicle cooling system 1 according to the present embodiment. The in-vehicle cooling system 1 includes a control device 10, a control angle instruction device 20, a control angle sensor 30, a water temperature sensor 40, a water pump WP, an electric water valve EWV, a radiator RAD, and a cooling water pipe PP. The in-vehicle cooling system 1 cools an apparatus to be cooled (for example, engine ENG) using cooling water flowing in the cooling water pipe PP.

The cooling water pipe PP includes a cooling water pipe PP1 to a cooling water pipe PP6. The cooling water pipe PP1 connects the engine ENG and the electric water valve EWV. The cooling water pipe PP2 connects the electric water valve EWV and the radiator RAD. The cooling water pipe PP3 connects the radiator RAD and a junction CP. The cooling water pipe PP4 connects the electric water valve EWV and the junction CP. The cooling water pipe PP5 connects the junction CP and the water pump WP. The cooling water pipe PP6 connects the water pump WP and the engine ENG.

In FIG. 1, a case in which the electric water valve EWV is placed upstream of the radiator RAD is described, but placement of the electric water valve EWV in the embodiment of the present invention is not limited thereto. For example, the electric water valve EWV may also be placed at a position of the junction CP shown in FIG. 1, that is, downstream of the radiator RAD.

The radiator RAD lowers a water temperature of cooling water supplied from the cooling water pipe PP2, and causes the cooling water whose water temperature is lowered to flow out to the cooling water pipe PP3.

Among the cooling water pipes PP described above, the cooling water pipe PP4 causes cooling water supplied from the cooling water pipe PP1 to flow out to the junction CP without going through the radiator RAD. In a following description, the cooling water pipe PP4 is also referred to as a bypass pipe.

The water temperature sensor 40 detects a water temperature WT of the cooling water in the cooling water pipe PP, and outputs a detected water temperature WT to the control device 10. In the present embodiment, the water temperature sensor 40 detects a water temperature WT of the cooling water of the cooling water pipe PP1, but embodiments of the present invention are not limited thereto. The water temperature sensor 40 may also detect a water temperature WT of the cooling water of the cooling water pipe PP2, the cooling water pipe PP3, the cooling water pipe PP5, or the cooling water pipe PP6.

The water pump WP pressurizes cooling water and circulates cooling water in the cooling water pipe PP. In the present embodiment, the water pump WP is driven by a rotational force of the engine ENG. When this water pump WP is an electric pump, the water pump may operate on the basis of control of the control angle instruction device 20.

The control angle instruction device 20 is an engine electronic control unit (ECU) which controls the engine ENG in the present embodiment. The control angle instruction device 20 increases the amount of cooling water supplied to the radiator RAD when the water temperature WT is high, and decreases the amount of cooling water supplied to the radiator RAD when the water temperature WT is low. Specifically, the control angle instruction device 20 outputs information indicating a control angle of the electric water valve EWV (control angle instruction TOA) to the control device 10 on the basis of the water temperature WT output by the water temperature sensor 40.

The control device 10 controls the electric water valve EWV on the basis of an instruction of the control angle instruction device 20 and control angle information TS detected by the control angle sensor 30.

The electric water valve EWV controls a flow rate of the cooling water in the cooling water pipe PP. In addition, the electric water valve EWV selects a cooling water pipe PP supplying cooling water among the plurality of cooling water pipes PP. In this example, the electric water valve EWV operates on the basis of a drive signal DS output from the control device 10.

A specific example of the configuration of this electric water valve EWV will be described with reference to FIGS. 2 to 9.

[Specific Example of Configuration of the Electric Water Valve EWV]

FIGS. 2 to 8 are diagrams which show examples of a configuration of a flow path of the electric water valve EWV according to the present embodiment.

Figure 2:
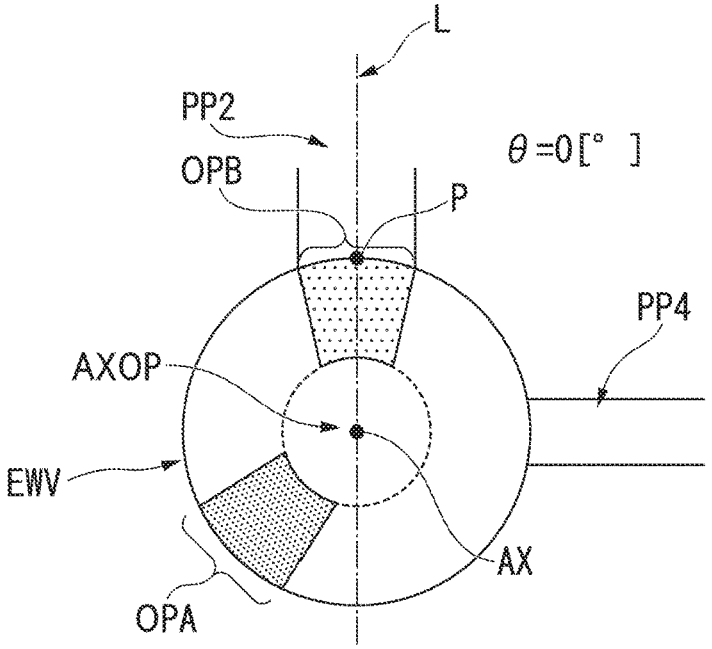
FIG. 2 is a diagram which shows an example of a configuration of a flow path of an electric water valve when a control angle is 0°.

FIG. 2 is a diagram which shows an example of the configuration of the flow path of the electric water valve EWV when a control angle θ is 0°. This electric water valve EWV includes a first opening OPA, a second opening OPB, and an axial opening AXOP. The electric water valve EWV causes cooling water flowing in from the axial opening AXOP to flow out from the first opening OPA and the second opening OPB. The first opening OPA and second opening OPB rotate around a rotation axis AX.

Here, an angle on the rotation axis AX formed by a point P which is a center point of the second opening OPB and a reference line L which is a center line of the cooling water pipe PP2 is referred to as a control angle θ.

The electric water valve EWV includes an electric motor (not shown). This electric motor causes the first opening OPA and the second opening OPB to rotate around the rotation axis AX.

A specific value of the control angle θ is determined on the basis of the cooling performance and the like required for the in-vehicle cooling system 1. The specific value of the control angle θ in a following description is an example in the present embodiment.

A shape of the electric water valve EWV may be a cylindrical shape or a spherical shape. In the following description, as an example, a case in which an opening portion of the cooling water pipe PP2 and an opening portion of the cooling water pipe PP4 are disposed on a rotation plane when the first opening OPA and the second opening OPB of the electric water valve EWV rotate around the rotation axis AX will be described.

[Stage St0: A Case that the Control Angle θ is 0° to 45°)

When the control angle θ is 0°, the first opening OPA does not open to any of the cooling water pipes PP. For this reason, when the control angle θ is 0°, cooling water does not flow out from the first opening OPA. In addition, when the control angle θ is 0°, the second opening OPB opens to the cooling water pipe PP2. For this reason, when the control angle θ is 0°, cooling water flows out to the cooling water pipe PP2 from the second opening OPB. In addition, when the control angle θ is 0°, neither the first opening OPA nor the second opening OPB opens to the cooling water pipe PP4. For this reason, cooling water does not flow into the cooling water pipe PP4 from the electric water valve EWV.

That is, when the control angle θ is 0°, the whole amount of cooling water flowing in from the axial opening AXOP flows into the cooling water pipe PP2 via the second opening OPB.

A relationship between the control angle θ described herein and an amount of cooling water flowing into each cooling water pipe PP will be described with reference to FIG. 9.

Figure 9:
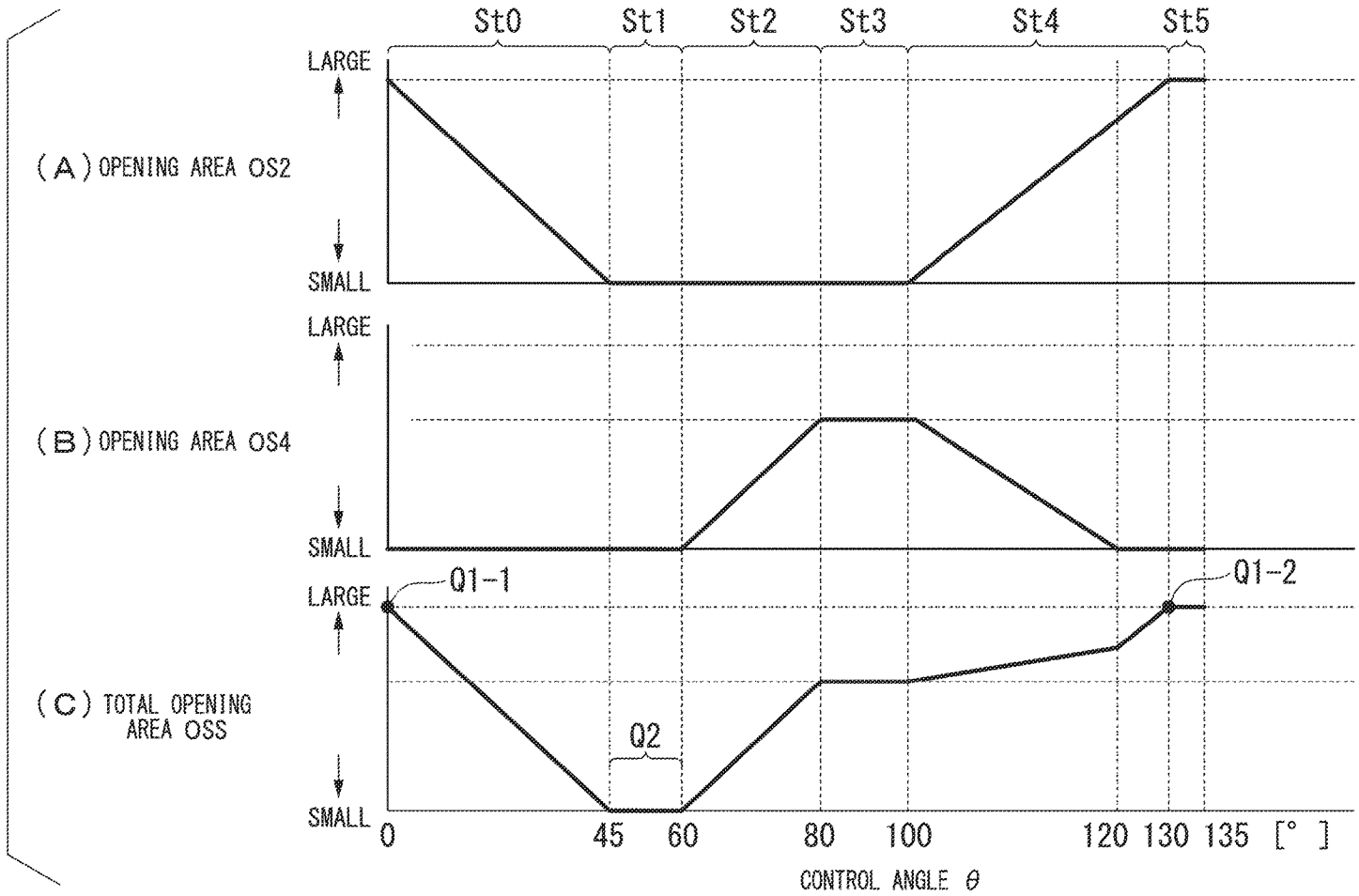
FIG. 9 is a diagram which shows an example of an opening area of the electric water valve according to the present embodiment with respect to a cooling water pipe.

FIG. 9 is a diagram which shows an example of an opening area OS of the electric water valve EWV according to the present embodiment with respect to the cooling water pipe PP. As shown in FIG. 9, when the control angle θ is 0°, an opening area OS2 to the cooling water pipe PP2 is maximized (maximum), and an opening area OS4 to the cooling water pipe PP4 is minimized (minimum).

In addition, when the control angle θ is 0°, a total opening area OSS which is a total of the opening area OS2 and the opening area OS4 is maximized (maximum). A maximum value of this total opening area OSS is also referred to as a maximum value Q1-1.

When the control angle θ changes from 0° to 45°, the opening area OS2 (that is, an inflow area to the cooling water pipe PP2) monotonically decreases and the opening area OS4 (that is, an inflow area to the cooling water pipe PP4) does not change. A section in which the control angle θ ranges from 0° to 45° is referred to as a stage St0.

[Stage St1: A Case that the Control Angle θ is 45° to 60°)

Figure 3:
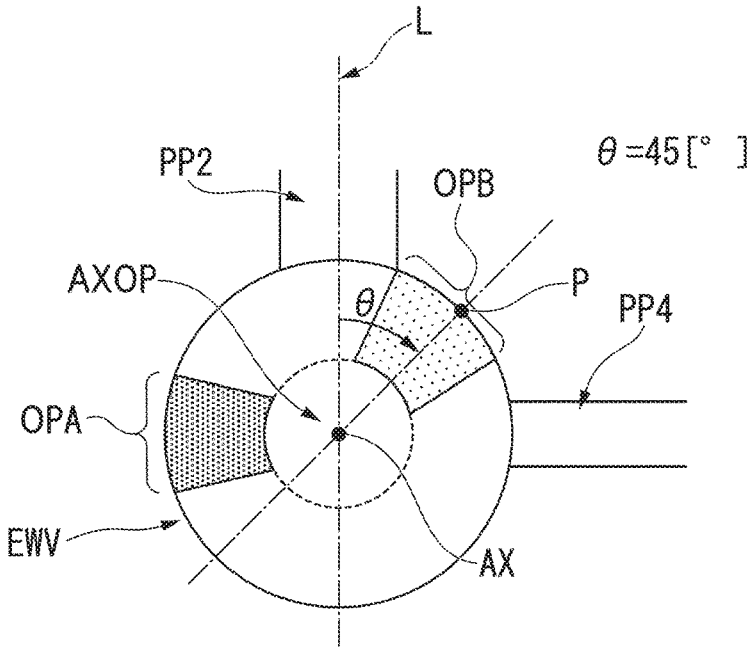
FIG. 3 is a diagram which shows an example of the configuration of the flow path of the electric water valve when the control angle is 45°.

FIG. 3 is a diagram which shows an example of the configuration of the flow path of the electric water valve EWV when the control angle θ is 45°.

Figure 4:
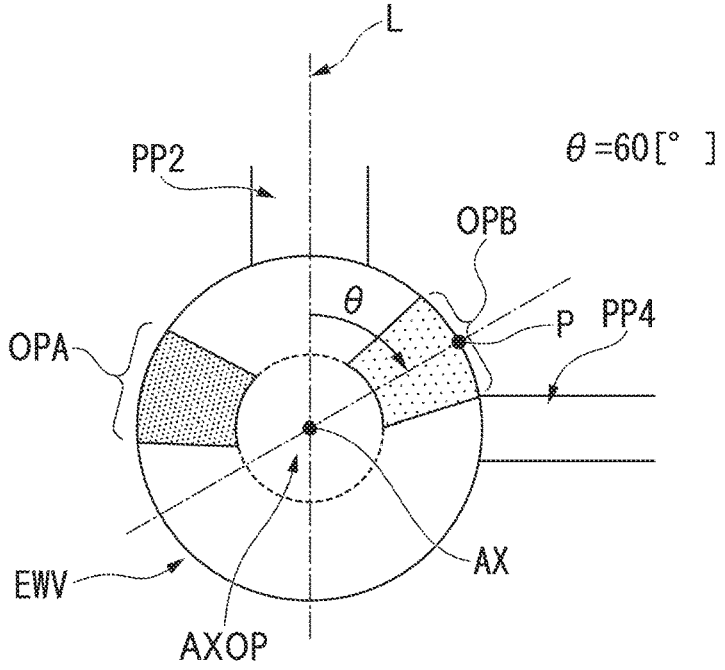
FIG. 4 is a diagram which shows an example of the configuration of the flow path of the electric water valve when the control angle is 60°.

FIG. 4 is a diagram which shows an example of the configuration of the flow path of the electric water valve EWV when the control angle θ is 60°.

When the control angle θ is 45° to 60°, the first opening OPA and the second opening OPB do not open to any of the cooling water pipes PP. For this reason, when the control angle θ is 45° to 60°, cooling water does not flow out from the first opening OPA and the second opening OPB.

That is, when the control angle θ is 45° to 60°, cooling water flowing in from the axial opening AXOP does not flow into any of the cooling water pipes PP. For this reason, when the control angle θ is 45° to 60°, the cooling water does not circulate in the cooling water pipes PP.

As shown in FIG. 9, when the control angle θ is 45° to 60°, the opening area OS2 to the cooling water pipe PP2 is minimized (minimum) (zero in the case of this example), and the opening area OS4 to the cooling water pipe PP4 is minimized (minimum) (zero in the case of this example).

In addition, when the control angle θ is 45° to 60°, the total opening area OSS which is a total of the opening area OS2 and the opening area OS4 is minimized (minimum) (zero in the case of this example). A minimum value of this total opening area OSS is referred to as a minimum value Q2. A section in which this control angle θ ranges from 45° to 60° is referred to as stage St1.

[Stage St2: A Case that the Control Angle θ is 60° to 80°)

Figure 5:
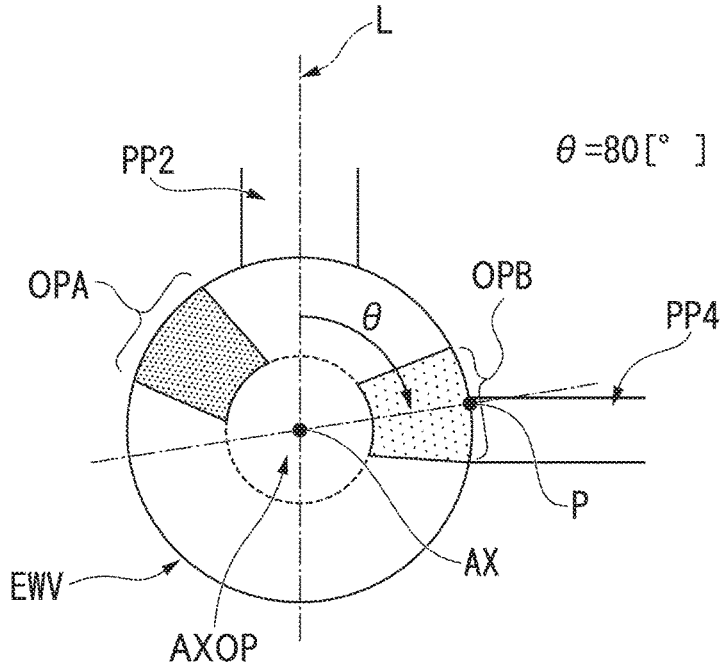
FIG. 5 is a diagram which shows an example of the configuration of the flow path of the electric water valve when the control angle is 80°.

FIG. 5 is a diagram which shows an example of the configuration of the flow path of the electric water valve EWV when the control angle θ is 80°.

When the control angle θ is 80°, the first opening OPA does not open to any of the cooling water pipes PP. For this reason, when the control angle θ is 80°, cooling water does not flow out from the first opening OPA. In addition, when the control angle θ is 80°, the second opening OPB opens to the cooling water pipe PP4. For this reason, when the control angle θ is 80°, cooling water flows out to the cooling water pipe PP4 from the second opening OPB. In addition, when the control angle θ is 80°, neither the first opening OPA nor the second opening OPB opens to the cooling water pipe PP2. For this reason, cooling water does not flow into the cooling water pipe PP2 from the electric water valve EWV.

That is, when the control angle θ is 80°, the whole amount of cooling water flowing in from the axial opening AXOP flows into the cooling water pipe PP4 via the second opening OPB.

As shown in FIG. 9, when the control angle θ is 80°, the opening area OS2 to the cooling water pipe PP2 is minimized (minimum) and the opening area OS4 to the cooling water pipe PP4 is maximized (maximum).

In addition, when the control angle θ changes from 60° to 80°, the opening area OS2 (that is, the inflow area to the cooling water pipe PP2) does not change and the opening area OS4 (that is, the inflow area to the cooling water pipe PP4) monotonically increases. A section in which the control angle θ changes from 60° to 80° is referred to as a stage St2.

[Stage St3: A Case that the Control Angle θ is 80° to 100°)

Figure 6:
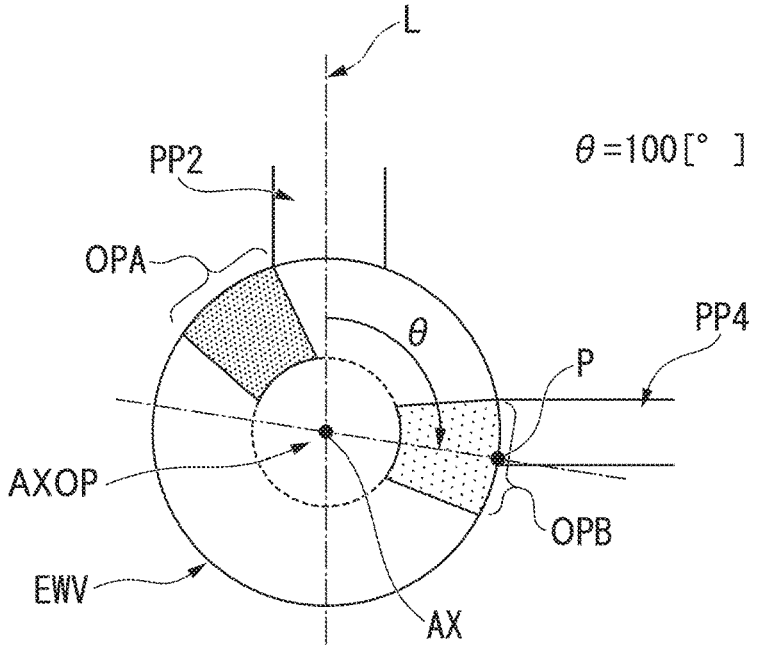
FIG. 6 is a diagram which shows an example of the configuration of the flow path of the electric water valve when the control angle is 100°.

FIG. 6 is a diagram which shows an example of the configuration of the flow path of the electric water valve EWV when the control angle θ is 100°.

When the control angle θ is 100°, the first opening OPA does not open to any of the cooling water pipes PP. For this reason, when the control angle θ is 100°, cooling water does not flow out from the first opening OPA. In addition, when the control angle θ is 100°, the second opening OPB opens to the cooling water pipe PP4. For this reason, when the control angle θ is 100°, cooling water flows out to the cooling water pipe PP4 from the second opening OPB. In addition, when the control angle θ is 100°, neither the first opening OPA nor the second opening OPB opens to the cooling water pipe PP2. For this reason, cooling water does not flow into the cooling water pipe PP2 from the electric water valve EWV.

That is, when the control angle θ is 100°, the whole amount of cooling water flowing in from the axial opening AXOP flows into the cooling water pipe PP4 via the second opening OPB.

As shown in FIG. 9, when the control angle θ is 100°, the opening area OS2 to the cooling water pipe PP2 is minimized (minimum) and the opening area OS4 to the cooling water pipe PP4 is maximized (maximum).

In addition, when the control angle θ changes from 80° to 100°, the opening area OS2 (that is, the inflow area to the cooling water pipe PP2) does not change and the opening area OS4 (that is, the inflow area to the cooling water pipe PP4) does not change. That is, neither the opening area OS2 nor the opening area OS4 changes in a process in which the control angle θ changes from 80° to 100°. A section in which the control angle θ changes from 80° to 100° is referred to as a stage St3.

[Stage St4: A Case that the Control Angle θ is 100° to 130°)

Figure 7:
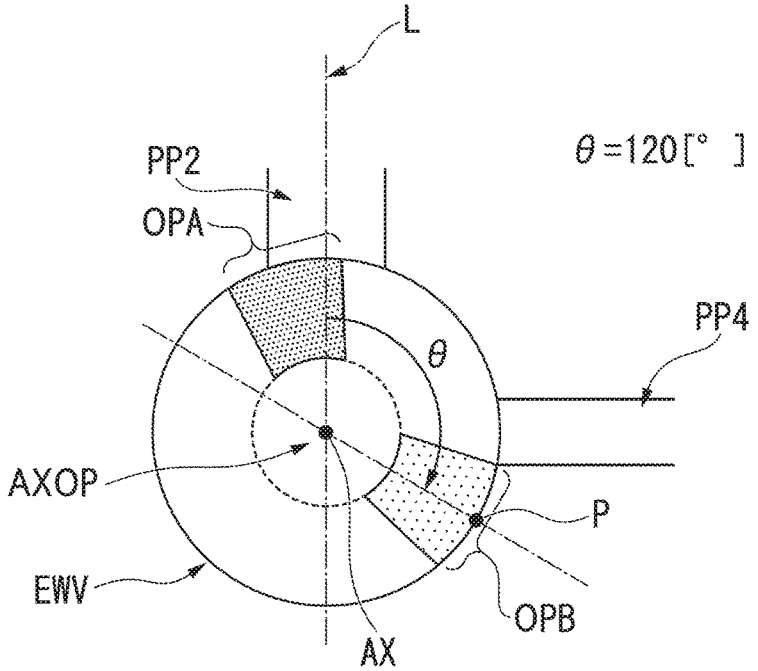
FIG. 7 is a diagram which shows an example of the configuration of the flow path of the electric water valve when the control angle is 120°.

FIG. 7 is a diagram which shows an example of the configuration of the flow path of the electric water valve EWV when the control angle θ is 120°.

When the control angle θ is 120°, the first opening OPA opens to the cooling water pipe PP2. For this reason, when the control angle θ is 120°, cooling water flows out to the cooling water pipe PP2 from the first opening OPA. In addition, when the control angle θ is 120°, the second opening OPB does not open to any of the cooling water pipes PP. For this reason, when the control angle θ is 120°, cooling water does not flow out from the second opening OPB to any of the cooling water pipes PP. Moreover, when the control angle θ is 120°, the first opening OPA opens to the cooling water pipe PP2. For this reason, cooling water flows into the cooling water pipe PP2 from the electric water valve EWV.

That is, when the control angle θ is 120°, the whole amount of cooling water flowing in from the axial opening AXOP flows into the cooling water pipe PP2 via the first opening OPA.

As shown in FIG. 9, when the control angle θ is 120°, the opening area OS4 to the cooling water pipe PP4 is minimized (minimum). In addition, when the control angle θ is 130°, the opening area OS2 to the cooling water pipe PP2 is maximized (maximum).

Moreover, when the control angle θ is 130°, the total opening area OSS which is a total of the opening area OS2 and the opening area OS4 is maximized (maximum). A maximum value of this total opening area OSS is referred to as a maximum value Q1-2.

In addition, if the control angle θ changes from 100° to 130°, the opening area OS2 (that is, the inflow area to the cooling water pipe PP2) monotonically increases and the opening area OS4 (that is the inflow area to the cooling water pipe PP4) monotonically decreases. A section in which the control angle θ ranges from 100° to 130° is referred to as a stage St4.

[Stage St5: A Case that the Control Angle θ is 130° to 135°)

Figure 8:
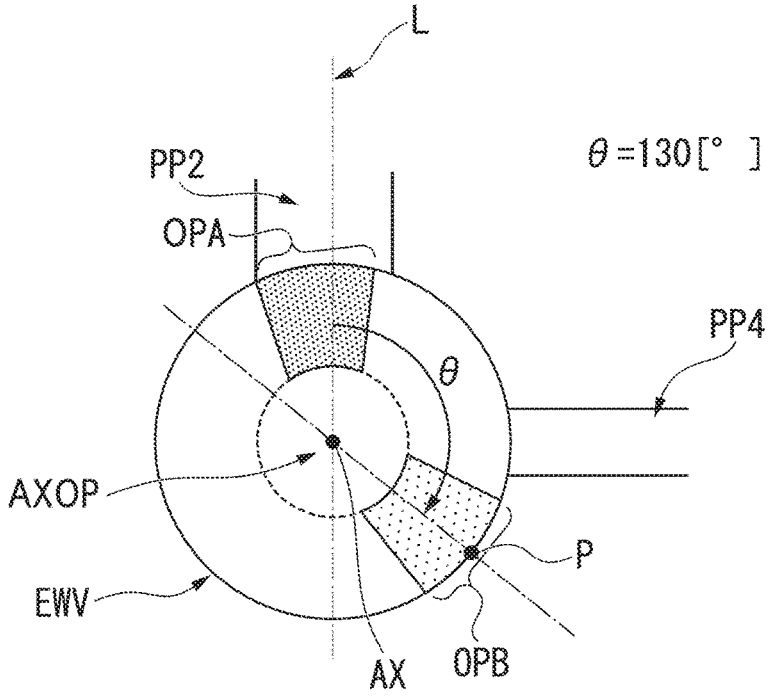
FIG. 8 is a diagram which shows an example of the configuration of the flow path of the electric water valve when the control angle is 130°.

FIG. 8 is a diagram which shows an example of the configuration of the flow path of the electric water valve EWV when the control angle θ is 130°.

When the control angle θ is 130° to 135°, the first opening OPA opens to the cooling water pipe PP2. For this reason, when the control angle θ is 130° to 135°, cooling water flows out to the cooling water pipe PP2 from the first opening OPA. In addition, when the control angle θ is 130° to 135°, the second opening OPB does not open to any of the cooling water pipes PP. For this reason, when the control angle θ is 130° to 135°, cooling water does not flow out to any of the cooling water pipes PP from the second opening OPB. In addition, when the control angle θ is 130° to 135°, the first opening OPA opens to the cooling water pipe PP2. For this reason, cooling water flows into the cooling water pipe PP2 from the electric water valve EWV.

That is, when the control angle θ is 130° to 135°, the whole amount of cooling water flowing in from the axial opening AXOP flows into the cooling water pipe PP2 via the first opening OPA.

As shown in FIG. 9, when the control angle θ is 130° to 135°, the opening area OS2 to the cooling water pipe PP2 is maximized (maximum) and the opening area OS4 to the cooling water pipe PP4 is minimized (minimum).

In addition, when the control angle θ is 130° to 135°, the total opening area OSS which is a total of the opening area OS2 and the opening area OS4 is maximized (maximum).

In addition, when the control angle θ changes from 130° to 135°, the opening area OS2 (that is, the inflow area to the cooling water pipe PP2) does not change and the opening area OS4 (that is, the inflow area to the cooling water pipe PP4) does not change. That is, neither the opening area OS2 nor the opening area OS4 change in a process in which the control angle θ changes from 130° to 135°.

A section in which the control angle θ changes from 130° to 135° is referred to as a stage St5.

The electric water valve EWV of the present embodiment has control angles θ at which the total opening area OSS is maximized (maximum) in the stage St0 and the stage St5. Specifically, the electric water valve EWV has the maximum value Q1-1 of the total opening area OSS when a control angle θ of the stage St0 is 0°. In addition, the electric water valve EWV has the maximum value Q1-2 of the total opening area OSS when a control angle θ of the stage St5 is 130° to 135°. That is, the electric water valve EWV of the present embodiment has a control angle θ at which the total opening area OSS is maximized in any of a normal rotation direction and a reverse rotation direction with the minimum value Q2 of the total opening area OSS interposed therebetween.

[Modified Example of the Configuration of the Electric Water Valve EWV]

A modified example of the configuration of the electric water valve EWV will be described with reference to FIGS. 10 and 11.

Figure 10:
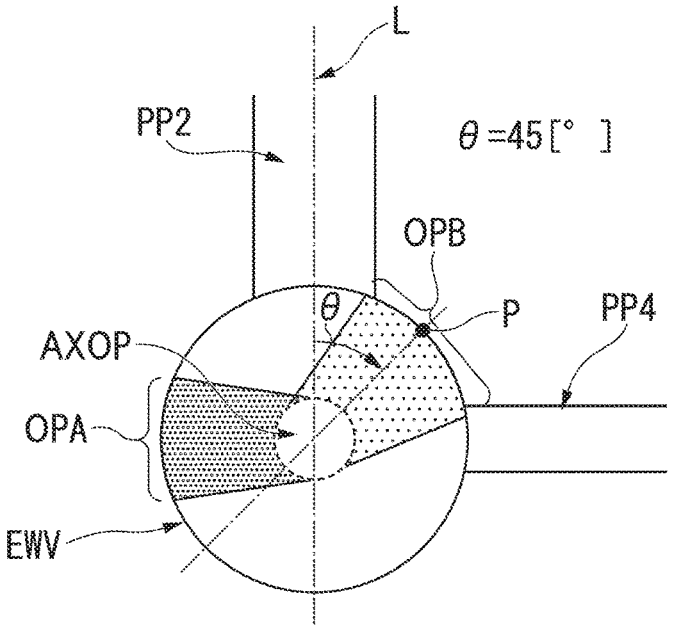
FIG. 10 is a diagram which shows a modified example of the configuration of the flow path of the electric water valve.

FIG. 10 is a diagram which shows a modified example of the configuration of the flow path of the electric water valve EWV.

Figure 11:
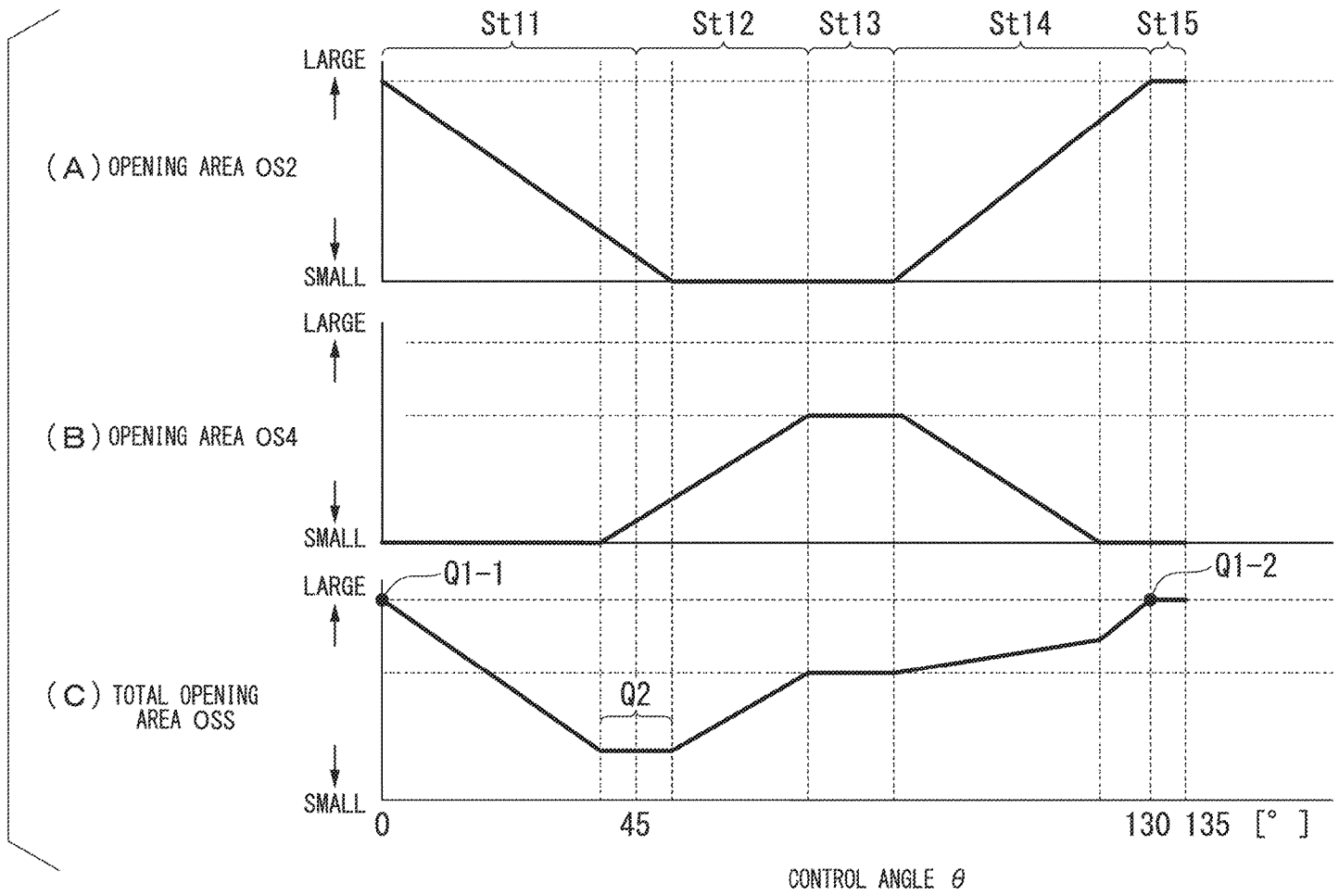
FIG. 11 is a diagram which shows a modified example of an opening area of the electric water valve with respect to the cooling water pipe.

FIG. 11 is a diagram which shows a modified example of an opening area of the electric water valve EWV of the present embodiment with respect to the cooling water pipe.

In a flow path of an electric water valve EWV of a modified example shown in FIGS. 10 and 11, a stage St1, that is, a state in which both the opening area OS2 and the opening area OS4 become zero, among stage St0 to stage St5 described above is not present. A stage St11 shown in FIG. 11 corresponds to the stage St1 described above and a stage St12 corresponds to the stage St2.

Here, a specific example of a relationship between the control angle θ in the stage St11 and the stage St12 and an inflow amount to each cooling water pipe PP from the second opening OPB will be described. The inflow amount to each cooling water pipe PP from the first opening OPA is zero in the stage St11 and the stage St12, and thus specific description thereof will be omitted.

When the control angle θ is 0°, the second opening OPB opens to the cooling water pipe PP2. For this reason, when the control angle θ is 0°, cooling water flows out to the cooling water pipe PP2 from the second opening OPB. In addition, when the control angle θ is 0°, the second opening OPB does not open to the cooling water pipe PP4. For this reason, cooling water does not flow into the cooling water pipe PP4 from the electric water valve EWV.

That is, when the control angle θ is 0°, the whole amount of cooling water flowing in from the axial opening AXOP flows into the cooling water pipe PP2 via the second opening OPB.

As shown in FIG. 11, when the control angle θ is 0°, the opening area OS2 to the cooling water pipe PP2 is maximized (maximum) and the opening area OS4 to the cooling water pipe PP4 is minimized (minimum).

In addition, when the control angle θ is 0°, the total opening area OSS which is a total of the opening area OS2 and the opening area OS4 is maximized (maximum). A maximum value of this total opening area OSS is referred to as the maximum value Q1-1.

When the control angle θ is 45°, the second opening OPB opens to both the cooling water pipe PP2 and the cooling water pipe PP4. For this reason, when the control angle θ is 45°, cooling water flows out to the cooling water pipe PP2 and the cooling water pipe PP4 from the second opening OPB.

That is, when the control angle θ is 45°, cooling water flowing in from the axial opening AXOP is divided in accordance with an opening area and flows into the cooling water pipe PP2 and the cooling water pipe PP4 via the second opening OPB.

A stage St13 to a stage St15 shown in FIG. 11 are the same as the stage St3 to the stage St5 described above, and thus description thereof will be omitted.

Here, the electric water valve EWV of the present embodiment has control angles θ at which the total opening area OSS is maximized (maximum) in the stage St11 and the stage St15. Specifically, the electric water valve EWV has the maximum value Q1-1 of the total opening area OSS when a control angle θ of the stage St11 is 0°. In addition, the electric water valve EWV has the maximum value Q1-2 of the total opening area OSS when a control angle θ of the stage St15 is 130° to 135°. That is, the electric water valve EWV of the present embodiment has a control angle θ at which the total opening area OSS is maximized in any of the normal rotation direction and the reverse rotation direction with the minimum value Q2 of the total opening area OSS interposed therebetween.

[Specific Example of a Functional Configuration of the Control Device 10]

A control angle θ of the electric water valve EWV described above changes according to an operation of an electric motor (not shown) on the basis of the drive signal DS output from the control device 10. A mechanism in which the control device 10 generates the drive signal DS will be described with reference to FIG. 12.

Figure 12:
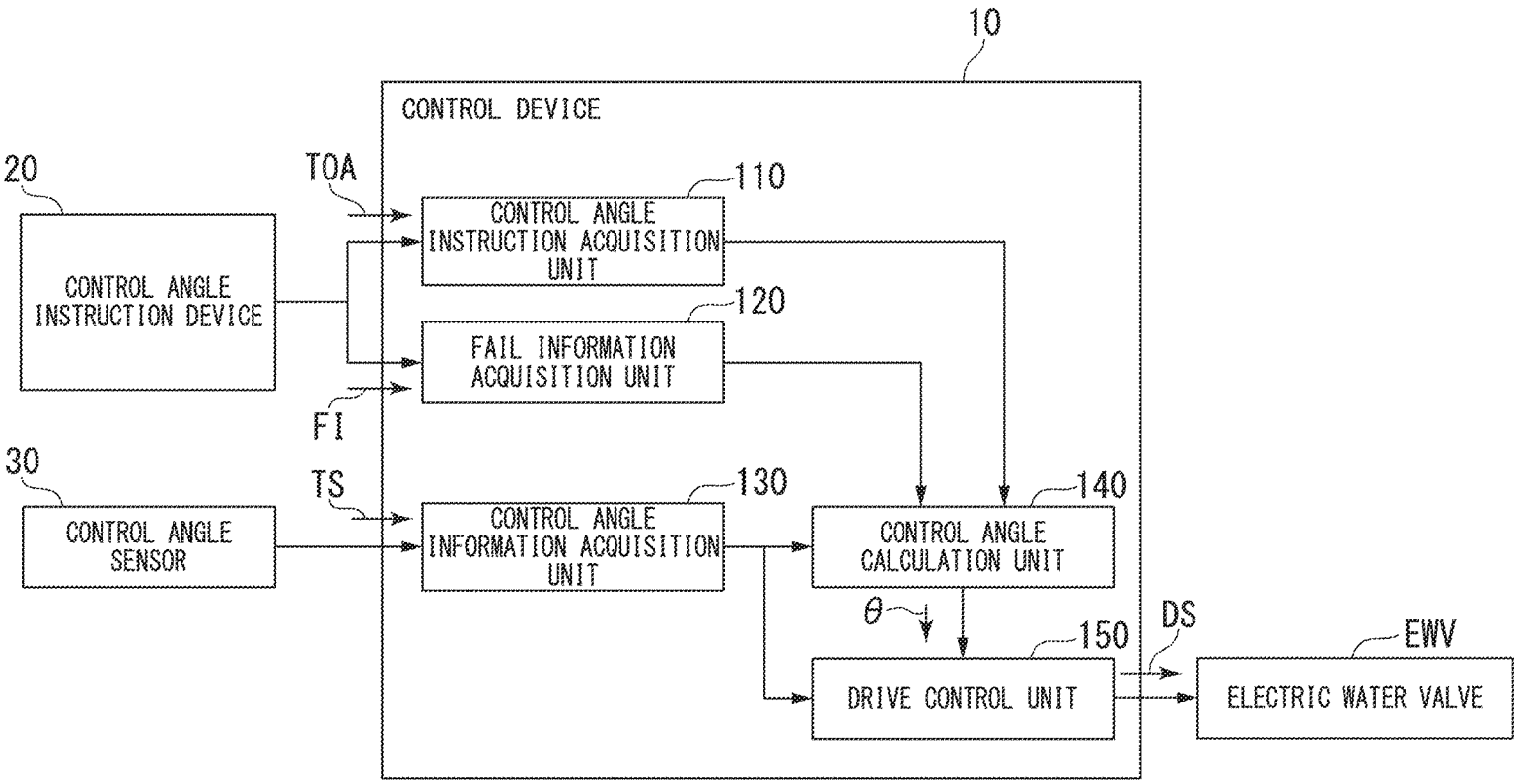
FIG. 12 is a diagram which shows an example of a functional configuration of a control device according to the present embodiment.

FIG. 12 is a diagram which shows an example of a functional configuration of the control device 10 according to the present embodiment. Here, the control angle instruction device 20 outputs fail information FI to the control angle instruction device 20, for example, when an abnormal water temperature WT occurs. The fail information FI is an instruction (expansion instruction) for expanding the opening area OS of the electric water valve EWV.

As described above, the electric water valve EWV may have a minimized opening area OS. In the example described above, the electric water valve EWV has a minimum value Q2 of the total opening area OSS when the control angle θ is 45°. In such a case, the flow rate of cooling water flowing in the cooling water pipe PP becomes relatively small. In the example described above, when the control angle θ of the electric water valve EWV is 45°, the flow rate of cooling water flowing in the cooling water pipe PP substantially becomes zero. In such a case, since a cooling force of the in-vehicle cooling system 1 with respect to an apparatus (for example, the engine ENG) to be cooled is not sufficient, there is a possibility that an abnormality may occur in the apparatus to be cooled.

The control angle instruction device 20 expands the total opening area OSS of the electric water valve EWV by outputting the fail information FI to the control device 10. Accordingly, the in-vehicle cooling system 1 increases the flow rate of cooling water flowing in the cooling water pipe PP and ensures a cooling force with respect to an apparatus to be cooled. A functional configuration of the control device 10 for ensuring a cooling force when an abnormal water temperature WT occurs as described above will be described.

The control device 10 includes a control angle instruction acquisition unit 110, a fail information acquisition unit 120, a control angle information acquisition unit 130, a control angle calculation unit 140, and a drive control unit 150.

The control angle instruction acquisition unit 110 acquires a control angle instruction TOA output from the control angle instruction device 20. This control angle instruction TOA includes information indicating the control angle θ of the electric water valve EWV. That is, the control angle instruction acquisition unit 110 acquires the control angle instruction TOA of the electric water valve EWV.

The fail information acquisition unit 120 acquires fail information FI output from the control angle instruction device 20. This fail information FI is information indicating whether to expand the opening area OS (expansion instruction). That is, the fail information acquisition unit 120 acquires fail information FI (expansion instruction) indicating whether to expand the opening area OS. This fail information acquisition unit 120 is also referred to as an expansion instruction acquisition unit.

The control angle information acquisition unit 130 acquires a control angle θ of the electric water valve EWV. The control angle θ of the electric water valve EWV is acquired by the control angle sensor 30. The control angle sensor 30 includes, for example, a rotary encoder which detects a rotation angle of the rotation axis AX of the electric water valve EWV. The control angle sensor 30 outputs the rotation angle of the rotation axis AX as control angle information TS. That is, the control angle information TS is information which shows a current control angle θ of the electric water valve EWV.

The control angle calculation unit 140 calculates a control angle θ on the basis of the control angle instruction TOA, the fail information FI, and the control angle information TS.

The drive control unit 150 generates a drive signal DS on the basis of a control angle θ calculated by the control angle calculation unit 140. The drive control unit 150 outputs a generated drive signal DS to the electric water valve EWV. Accordingly, the electric water valve EWV is controlled by a control angle θ calculated by the control device 10.

A calculation procedure of a control angle θ performed by the control device 10 will be described with reference to FIG. 13.

Figure 13:
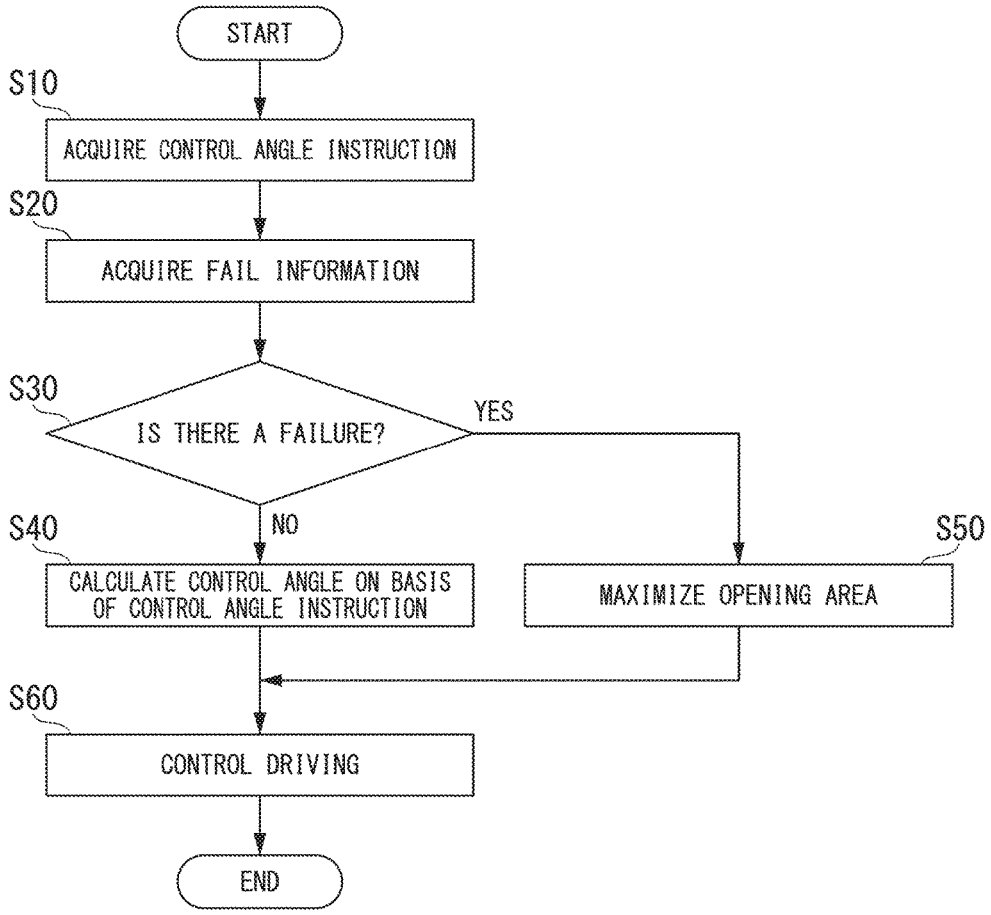
FIG. 13 is a diagram which shows an example of an operation of the control device according to the present embodiment.

FIG. 13 is a diagram which shows an example of an operation of the control device 10 according to the present embodiment.

The control angle instruction acquisition unit 110 acquires a control angle instruction TOA from the control angle instruction device 20 (step S10). The fail information acquisition unit 120 acquires fail information FI from the control angle instruction device 20 (step S20).

The control angle calculation unit 140 determines whether the fail information FI acquired in step S20 indicates "fail" (step S30). The control angle calculation unit 140 advances the processing to step S40 when the fail information FI does not indicate "fail", that is, when a failure does not occur (NO in step S30). In addition, the control angle calculation unit 140 advances the processing to step S50 when the fail information FI indicates "fail", that is, when a failure occurs (YES in step S30).

When a failure does not occur, the control angle calculation unit 140 calculates a control angle θ on the basis of the control angle instruction TOA acquired in step S10 (step S40).

On the other hand, when a failure occurs, the control angle calculation unit 140 performs control to maximize the total opening area OSS (step S50).

Here, the control angle calculation unit 140 determines a change direction of the control angle θ on the basis of control angle information TS when the total opening area OSS is maximized. Specifically, the control angle calculation unit 140 changes the control angle θ in a direction in which the total opening area OSS does not decrease in the process of maximizing the control angle θ.

[A Case that a Control Angle θ is Changed in a Normal Rotation Direction]

The control angle calculation unit 140 changes a control angle θ in a direction (normal rotation direction) in which the control angle θ increases when a current control angle θ of the electric water valve EWV is 45° to 130°. That is, in this case, the control angle calculation unit 140 sets the total opening area OSS to the maximum value Q1-2.

[A Case that a Control Angle θ is Changed in a Reverse Rotation Direction]

The control angle calculation unit 140 changes a control angle θ in a direction (reverse rotation direction) in which the control angle θ decreases when a current control angle θ of the electric water valve EWV is 0° to 45°. That is, in this case, the control angle calculation unit 140 sets the total opening area OSS to the maximum value Q1-1.

As described above, the total opening area OSS monotonically increases toward the maximum value Q1-1 from the minimum value Q2. In addition, the total opening area OSS monotonically increases toward the maximum value Q1-2 from the minimum value Q2. That is, the total opening area OSS changes without being decreased by changing the control angle θ in the normal rotation direction or the reverse rotation direction with the minimum value Q2 as a boundary.

The control angle calculation unit 140 determines a change direction of the control angle θ on the basis of a comparison between the control angle θ indicated by the control angle information TS and the control angle θ corresponding to the minimum value Q2.

In other words, the control angle calculation unit 140 determines a change direction of the control angle θ by setting the change direction of the control angle to a direction in which the control angle θ decreases when a control angle θ is less than a median value of a variable range of the control angle θ of the electric water valve EWV and setting the change direction of the control angle θ to a direction in which the control angle θ increases when a control angle θ is equal to or greater than the median value of the variable range of the control angle θ of the electric water valve EWV.

That is, when a failure occurs, the control angle calculation unit 140 determines the change direction of the control angle θ on the basis of a current control angle θ of the electric water valve EWV, and changes the total opening area OSS to any maximum value Q1 of the maximum value Q1-1 and the maximum value Q1-2 on the basis of the determination result. That is, the control angle calculation unit 140 calculates a control angle θ of the electric water valve EWV by setting the control angle θ of the electric water valve EWV to a control angle θ corresponding to the maximum value Q1 of the change in the opening area OS when the fail information FI indicates expansion of the opening area OS (expansion instruction).

The drive control unit 150 outputs a drive signal DS to the electric water valve EWV based on a control angle θ calculated by the control angle calculation unit 140, thereby controlling the control angle θ of the electric water valve EWV (step S60) and ending a series of operations.

[Brief Summary of Embodiment]

As described above, the control device 10 controls the control angle θ of the electric water valve EWV on the basis of the fail information FI. The control device 10 expands the total opening area OSS of the electric water valve EWV when the fail information FI instructs expansion of a flow rate of cooling water. With such a configuration, the control device 10 can increase the flow rate of cooling water when a failure such as an abnormal increase and the like of the water temperature WT occurs.

In addition, the control device 10 determines whether to drive the electric water valve EWV in a direction of the normal rotation direction or a direction of the reverse rotation direction when the total opening area OSS is expanded. Specifically, the control device 10 determines whether to drive the electric water valve EWV in a direction toward the maximum value Q1-1 or a direction toward the maximum value Q1-2 among the maximum values Q1 of the total opening area OSS. Here, the control device 10 determines a drive direction on the basis of a current control angle θ.

In this determination, the control device 10 may drive the electric water valve EWV in a direction in which a change amount of a control angle θ is small. Specifically, when the change angle θ varies between 0° and 130°, if a current control angle θ is equal to or less than a half of the variable range (that is, 65°), the control device 10 drives the electric water valve EWV in the direction of the maximum value Q1-1. Moreover, if a current control angle θ is larger than a half of the variable range (that is, 65°), the control device drives the electric water valve EWV in the direction of the maximum value Q1-2. With such a configuration, the control device 10 can expand the total opening area OSS with a small amount of change in the control angle θ. That is, with such a configuration, the control device 10 can expand the total opening area OSS more quickly.

In addition, in the determination of the drive direction described above, the control device 10 may perform the determination with the minimum value Q2 of the total opening area OSS as a reference. That is, the control device 10 may determine a drive direction on the basis of a comparison between a control angle θ indicted by the control angle information TS (that is, a current control angle θ) and a control angle θ corresponding to the minimum value Q2 (control angle θ Q2). Specifically, the control device 10 drives the electric water valve EWV in the direction toward the maximum value Q1-1 if a current control angle θ is equal to or less than the control angle θ Q2, and drives the electric water valve EWV in the direction toward the maximum value Q1-2 if a current control angle is larger than the control angle θ Q2. With such a configuration, the control device 10 can change a control angle θ without going through the minimum value Q2 in a process in which the control angle θ is changed. That is, the control device 10 can change a control angle θ without decreasing the total opening area OSS. Accordingly, the control device 10 can prevent the flow rate of cooling water from decreasing in a process in which the control angle θ is changed when a failure occurs.

[Initial Value of the Control Angle θ]

The control device 10 may also set control angles θ at the time of startup and stopping, that is, initial values of the control angles θ, to values other than control angles θ at which the total opening area OSS becomes the minimum value Q2. That is, the control device 10 calculates the control angle θ of the electric water valve EWV by setting the initial value of the control angle θ of the electric water valve EWV to a control angle θ other than the control angle θ corresponding to the minimum value Q2 among control angles θ of the electric water valve EWV.

Due to freezing and/or biting of foreign matter, the electric water valve EWV may be stuck in some cases. With the configuration described above, the control device 10 can ensure the flow rate of cooling water at the time of startup even when the electric water valve EWV is stuck or the like.

In addition, the control device 10 can set the initial value of the control angle θ to a control angle θ at which the total opening area OSS becomes the maximum value Q1. With such a configuration, the control device 10 can set the flow rate of cooling water at the time of startup to a maximum flow rate even when the electric water valve EWV is stuck and the like.

[Control in the Case of Malfunction of the Electric Water Valve EWV]

The control device 10 can control the control angle θ by varying a drive force of the electric water valve EWV. For example, when the drive signal DS is a drive current supplied to the electric motor of the electric water valve EWV, the control device 10 makes a current value of this drive current variable. In addition, when the drive signal DS is a pulse width modulation (PWM) signal, the control device 10 makes a duty ratio of this PWM signal variable.

Here, in the control device 10, the control angle θ of the electric water valve EWV does not change with a drive force in a predetermined range in some cases. For example, when foreign matter is biting into a movable portion of the electric water valve EWV, the control angle θ does not change with the drive force in the predetermined range in some cases. In this case, a control angle indicated by the control angle instruction TOA (that is, a target value of the control angle) acquired by the control angle instruction acquisition unit 110 is different from the control angle θ of the electric water valve EWV (that is, a result of the control) acquired by the control angle information acquisition unit 130. Specifically, when the target control angle indicated by the control angle instruction TOA is changed from 45° to 90°, the control device 10 changes the control angle θ of the electric water valve EWV from 45° to 90°. At this time, for example, when biting occurs at a position at which the control angle θ of the electric water valve EWV is 60°, and the control angle θ does not change with the drive force in the predetermined range, the control angle θ of the electric water valve EWV becomes 60° with respect to the target control angle 90°. That is, a target value of the control angle is different from a result of the control.

In this case, the control device 10 increases a drive force of the electric water valve EWV. For example, when the drive signal DS is the PWM signal, the control device 1 sets the duty ratio of the drive signal DS to 50% and drives the electric water valve EWV when the control angle θ is changed using the drive force in the predetermined range. Moreover, the control device 10 sets the duty ratio of the drive signal DS to 100% and drives the electric water valve EWV when the control angle θ does not change with the drive force in the predetermined range.

In other words, when the control angle indicated by the control angle instruction TOA is different from the control angle θ of the electric water valve EWV acquired by the control angle information acquisition unit 130, the control device 10 outputs a drive signal DS indicating a drive force larger than a drive force at the time in which these control angles are not different from each other.

As described above, even when it is difficult to change the control angle θ due to biting of foreign matter or the like in the control device 10, it is possible to change the control angle θ by varying the drive force of the electric water valve EWV. As a result, the control device 10 changes the opening area OS of the electric water valve EWV and ensures a flow rate of cooling water. According to the control device 10 configured as described above, it is possible to reduce a possibility of the occurrence of situations in which apparatuses to be cooled overheat due to an insufficient flow rate of cooling water when an abnormality such as biting of foreign matter into the electric water valve EWV occurs.

In addition, the control device 10 may also reverse the electric motor of the electric water valve EWV when it is difficult to change the control angle θ due to biting of foreign matter or the like. For example, the control device 10 changes the total opening area OSS to the maximum value Q1 when a failure occurs. In this case, when it is difficult to change the control angle θ in a process in which the total opening area OSS is changed to the maximum value Q1-1, the control device 10 reverses the electric motor to change it to the maximum value Q1-2. With such a configuration, the control device 10 can ensure the flow rate of cooling water even when it is difficult to change the control angle θ due to biting of foreign matter or the like.

In addition, when it is difficult to change the control angle θ due to biting of foreign matter or the like, the control device 10 may increase the drive force of the electric water valve EWV and drive the electric water valve EWV in the direction in which the change amount of the control angle θ is small. Specifically, when the control angle θ varies between 0° and 130°, if a control angle at which biting occurs is equal to or less than a half of the variable range of the control angle θ (that is, 65°), the control device 10 drives the electric water valve EWV in the direction toward the maximum value Q1-1.

In addition, if the control angle at which biting occurs is larger than a half of the variable range of the control angle θ (that is, 65°), the control device 10 drives the electric water valve EWV in the direction toward the maximum value Q1-2. That is, the control device 10 determines the drive direction of the electric water valve EWV on the basis of a comparison between the control angle indicated by the control angle instruction TOA and the variable range of the control angle θ. With such a configuration, the control device 10 can expand the total opening area OSS with less change amount in the control angle θ even when it is difficult to change the control angle θ due to biting of foreign matter or the like. That is, with such a configuration, the control device 10 can expand the total opening area OSS more quickly.

[Modified Example]

In the example described above, a case in which the electric water valve EWV has two ejection openings such as the first opening OPA and the second opening OPB and functions as a three-way valve has been described, but the embodiment of the present invention is not limited thereto. The electric water valve EWV may take any configuration as long as a valve mechanism having the minimum value Q2 for the change in the opening area OS in accordance with the control angle θ is included.

Moreover, a case in which the electric water valve EWV is a rotary valve has been described in the example described above, but the embodiment is not limited thereto. The electric water valve EWV may also have a valve structure other than the rotary valve, such as a direct drive valve.

Although the embodiment of the present invention and the modified examples thereof have been described, the embodiment and modified examples are presented as examples and are not intended to limit the scope of the invention. The embodiment and modified examples can be implemented in various other forms, and various omissions, substitutions, modifications, and combinations can be made in a range not departing from the scope of the invention. The embodiment and modified examples are included in the scope of the invention, and at the same time are included in the invention described in the claims and the equivalent scope thereof.

Each device described above has a computer. Then, each procedure of a process of each device described above may be stored in a computer-readable recording medium in a program form, and a computer reads and may execute the program to perform the process. Here, the computer-readable recording medium refers to a magnetic disc, a magneto-optical disc, a CD-ROM, a DVD-ROM, a semiconductor memory, and the like. In addition, the computer program may be distributed to a computer by a communication line, and the computer receiving this distribution may execute the program.

Moreover, the program may be used to realize a part of the functions described above.

Furthermore, the program may also be a so-called difference file (difference program) which can realize the functions described above by combining with a program which has been already stored in a computer system.

What is claimed is:

1. A control device which is a device for controlling a control angle of a valve to control an opening area of the valve with respect to a pipe, the control device comprising:

a control angle instruction acquisition unit configured to acquire a control angle instruction indicating the control angle of the valve;

an expansion instruction acquisition unit configured to acquire an expansion instruction indicating whether to expand the opening area;

a control angle information acquisition unit configured to acquire control angle information indicating the control angle of the valve;

a control angle calculation unit configured to calculate the control angle of the valve on the basis of the control angle instruction acquired by the control angle instruction acquisition unit, the expansion instruction acquired by the expansion instruction acquisition unit, and the control angle information acquired by the control angle information acquisition unit; and a drive control unit configured to output drive information of the valve on the basis of the control angle calculated by the control angle calculation unit, wherein the valve and the pipe are configured such that the opening area is changed, within a control range of the control angle of the valve, to have maximum opening area control angles of the valve at which the opening area becomes a maximum value in any of an increasing direction and a decreasing direction of the control angle of the valve, with a minimum opening area control angle of the valve at which the opening area becomes a minimum value interposed between the maximum opening area control angles of the valve.

2. The control device according to claim 1, wherein the drive information includes information indicating a change direction of the control angle of the valve, the control angle calculation unit determines the change direction of the control angle on the basis of the control angle information when the expansion instruction indicates expansion of the opening area, and the drive control unit outputs the drive information including the change direction determined by the control angle calculation unit.

3. The control device according to claim 2, wherein the control angle calculation unit determines the change direction on the basis of comparison between the control angle indicated by the control angle information and the minimum opening area control angle.

4. The control device according to claim 2, wherein the drive information includes information indicating a drive force of the valve, and when a target control angle indicated by the control angle instruction is different from the control angle indicated by the control angle information, the drive control unit outputs the drive information indicating a larger drive force than a drive force of the valve when the target control angle is not different from the control angle indicated by the control angle information.

5. The control device according to claim 2, wherein the control angle calculation unit determines the change direction by setting the change direction to a direction in which the control angle of the valve decreases when the control angle indicated by the control angle information is less than a median value of a variable range of the control angle of the valve, and setting the change direction to a direction in which the control angle of the valve increases when the control angle indicated by the control angle information is equal to or larger than the median value of the variable range of the control angle of the valve.

6. The control device according to claim 1, wherein the control angle calculation unit calculates the control angle of the valve by setting an initial value of the control angle of the valve to a control angle other than the minimum opening area control angle among control angles of the valve.

7. The control device according to claim 1, wherein the control angle calculation unit calculates the control angle of the valve by setting the control angle of the valve to one of the maximum opening area control angles when the expansion instruction indicates expansion of the opening area.

8. A non-transitory computer readable recording medium to which a program is stored, wherein the program causes a computer included in a control device, which controls a control angle of a valve to control an opening area of the valve with respect to a pipe, to execute functions, wherein the functions comprise:

a control angle instruction acquisition step of acquiring a control angle instruction indicating the control angle for the valve;

an expansion instruction acquisition step of acquiring an expansion instruction instructing whether to expand the opening area;

a control angle information acquisition step of acquiring control angle information indicating the control angle of the valve;

a control angle calculation step of calculating the control angle of the valve on the basis of the control angle instruction acquired in the control angle instruction acquisition step, the expansion instruction acquired in the expansion instruction acquisition step, and the control angle information acquired in the control angle information acquisition step; and a drive control step of outputting drive information of the valve based on the control angle calculated in the control angle calculation step, wherein the valve is controlled such that the opening area is changed, within a control range of the control angle of the valve, to have maximum opening area control angles of the valve, at which the opening area becomes a maximum value, in any of an increasing direction and a decreasing direction of the control angle of the valve, with a minimum opening area control angle, at which the opening area becomes a minimum value, interposed between the maximum opening area control angles of the valve.

* * * * *